US007522025B2

(12) United States Patent
Zeitlberger et al.

(10) Patent No.: US 7,522,025 B2
(45) Date of Patent: Apr. 21, 2009

(54) SWITCHGEAR WITH A SWITCHING DEVICE AND AN ELECTRONIC COMPONENT AS WELL AS A SUPPLEMENTARY ELECTRICAL CIRCUIT FOR THE SWITCHGEAR

(75) Inventors: Philipp Zeitlberger, Horn (AT); Werner Falkner, Vitis (AT); Fritz Kaplanek, Vienna (AT)

(73) Assignee: Tyco Electronics Austria GmbH, Vienna (AT)

( * ) Notice: Subject to any disclaimer, the term of this patent is extended or adjusted under 35 U.S.C. 154(b) by 106 days.

(21) Appl. No.: 11/552,683

(22) Filed: Oct. 25, 2006

(65) Prior Publication Data

US 2007/0097602 A1 May 3, 2007

(30) Foreign Application Priority Data

Oct. 31, 2005 (EP) ..... 05023756

(51) Int. Cl.
*H01H 1/06* (2006.01)

(52) U.S. Cl. ..... 335/199; 335/128; 335/129; 335/130; 335/131; 335/290; 361/5; 361/6; 361/115; 361/142; 361/157; 361/160; 361/169.1; 361/172; 361/600; 361/605

(58) Field of Classification Search ..... 335/128–131, 335/199, 290; 361/5–6, 115, 142, 157, 160, 361/169.1, 172, 600, 605, 760, 801
See application file for complete search history.

(56) References Cited

U.S. PATENT DOCUMENTS

| | | | | |
|---|---|---|---|---|
| 3,089,010 | A * | 5/1963 | Koda | 335/152 |
| 3,763,448 | A * | 10/1973 | Walters | 335/135 |
| 4,041,425 | A * | 8/1977 | Brush et al. | 335/129 |
| 4,400,761 | A * | 8/1983 | Hayden et al. | 361/782 |
| 4,767,674 | A * | 8/1988 | Shirai et al. | 428/461 |
| 5,216,396 | A * | 6/1993 | Stahly | 335/80 |
| 5,567,991 | A * | 10/1996 | Schantz et al. | 307/10.1 |
| 2004/0145858 | A1 * | 7/2004 | Sakurada | 361/600 |
| 2004/0252421 | A1 * | 12/2004 | Knox et al. | 361/23 |
| 2004/0263293 | A1 * | 12/2004 | Saruwatari et al. | 335/128 |

FOREIGN PATENT DOCUMENTS

JP 03127424 5/1991

OTHER PUBLICATIONS

European Search Report dated Mar. 15, 2006 for Application No. EP 05 02 3756.

* cited by examiner

*Primary Examiner*—Elvin G Enad
*Assistant Examiner*—Mohamad A Musleh
(74) *Attorney, Agent, or Firm*—Barley Snyder LLC

(57) ABSTRACT

A switchgear comprises a switching device, such as a relay, with a switching mechanism. A printed-circuit board that is provided with at least one electronic component is electrically connected to the switching device to form a supplementary electrical circuit, which receives an operating voltage supplied to the switching device.

8 Claims, 5 Drawing Sheets

SWITCHGEAR WITH A SWITCHING DEVICE AND AN ELECTRONIC COMPONENT AS WELL AS A SUPPLEMENTARY ELECTRICAL CIRCUIT FOR THE SWITCHGEAR

FIELD OF THE INVENTION

The present invention relates to a switchgear with a switching device, such as a relay, provided with a connecting assembly and a supplementary electrical circuit, wherein the supplementary electrical circuit may be, for example, an electrical display circuit or an electrical protective circuit for the switchgear.

BACKGROUND OF THE INVENTION

It is known to design an electromechanical switchgear with a switching device, such as a relay, to be as small as possible in order to accommodate for restricted installation spaces encountered in the normal use of the switchgear. A typical switchgear, which is equipped with a switching device in the form of a relay, comprises a contact element acted upon by a switching mechanism. The switching mechanism is configured to bring the contact element into and out of contact with a mating-contact element. The relay comprises a magnet frame consisting of a coil former and a coaxial coil with a yoke. The magnet frame forms a pole face with which an armature interacts. The armature is connected to the contact element, for example, by a coupling device, so that the armature acts upon the contact element.

Additionally, applications for switchgears are known in which, apart from a switching device of this kind, an electrical display circuit or electrical protective circuit, for example, with electronic components, is provided. The electrical display circuit for the switchgear serves, for example, to indicate to a user the proper operation of the switchgear, for example, whether the switchgear is properly connected and being supplied with a voltage. Electronic components provided for this purpose include, for example, a light-emitting diode (LED), which illuminates when the switchgear is operating correctly. The electrical protective circuit for the switchgear serves, for example, to filter out any voltage peaks in a supply voltage in the case of a switchgear for alternating voltage. An example of an electrical protective circuit used for this purpose is an RC element, which can smooth high-frequency voltage peaks in the supply voltage.

When supplementary electrical circuits of this kind are provided in the switchgear, it is necessary to supply the supplementary electrical circuit with the operating voltage of the switchgear. The operating voltage is fed, for example, via an insulated wire, which has, for example, to be routed past the magnet frame of the relay. This is disadvantageous in that additional space is required at the locations at where the wire has to be routed past the magnet frame of the switching device, which increases the external dimensions of the switching device. Because an increase in the external dimensions of the switching device would in some instances prevent installation of the relay, for example, in a switch cabinet, it is impossible in such cases to provide an electrical display circuit or electrical protective circuit in the switchgear.

BRIEF SUMMARY OF THE INVENTION

It is therefore an object of the present invention to provide a switchgear in which an electrical display circuit and/or an electrical protective circuit can be provided, without substantially increasing the external dimensions of the switching device.

This and other objects are achieved by a switchgear comprising a switching device, such as a relay, with a switching mechanism. A printed-circuit board that is provided with at least one electronic component is electrically connected to the switching device to form a supplementary electrical circuit, which receives an operating voltage supplied to the switching device.

This and other objects are further achieved by a switchgear comprising a relay with a magnet frame consisting of a coil former and a coaxial coil with a yoke. The coil has at least one coil terminal pin extending there from configured to supply an operating voltage to the coil. A printed-circuit board is provided with at least one electronic component. The printed-circuit board is electrically connected to the coil terminal pin to form a supplementary electrical circuit.

DETAILED DESCRIPTION OF THE INVENTION

Figure 1:
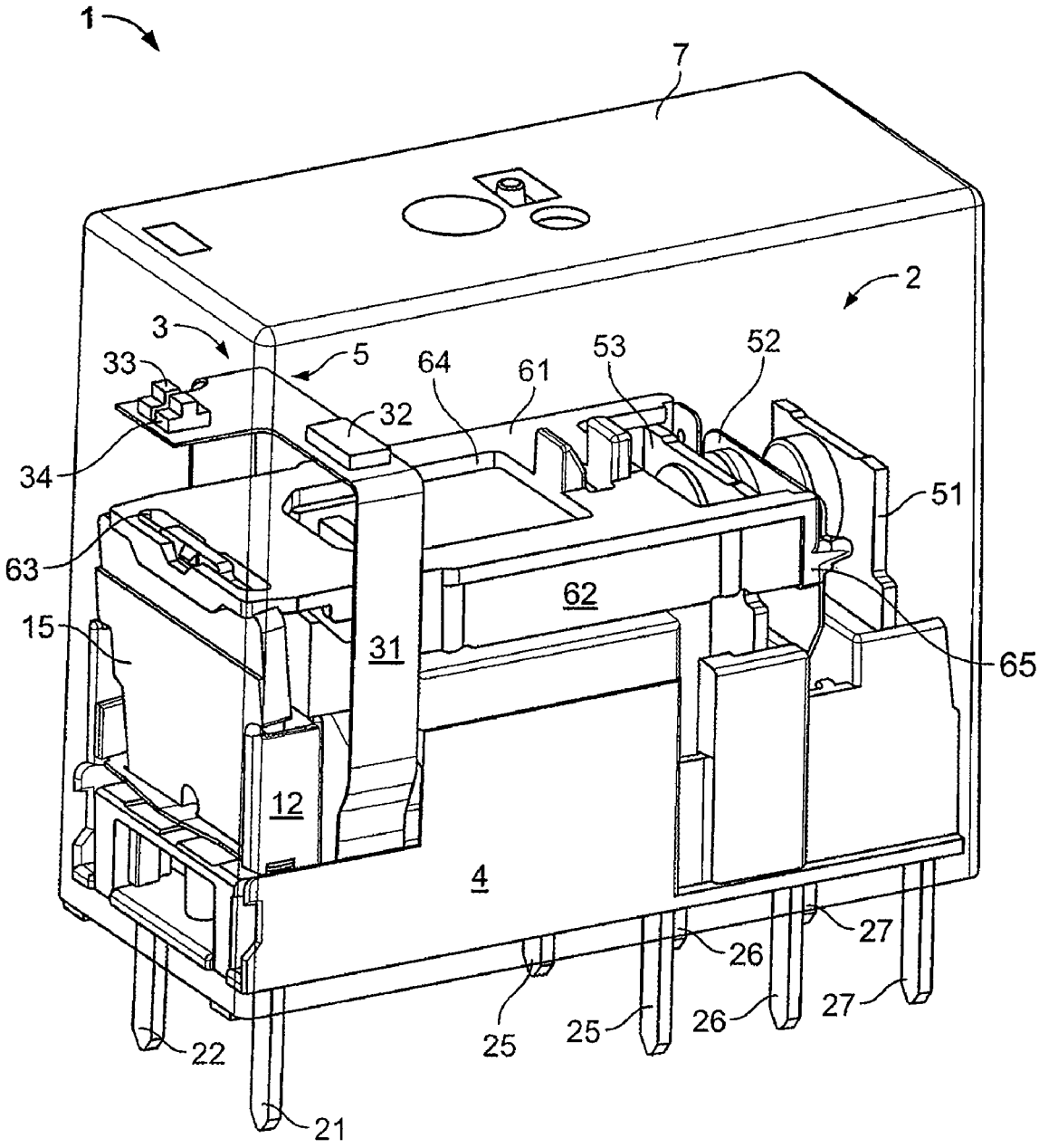
FIG. 1 is a first schematic perspective view of a switchgear according to an embodiment of the invention.
Figure 2:
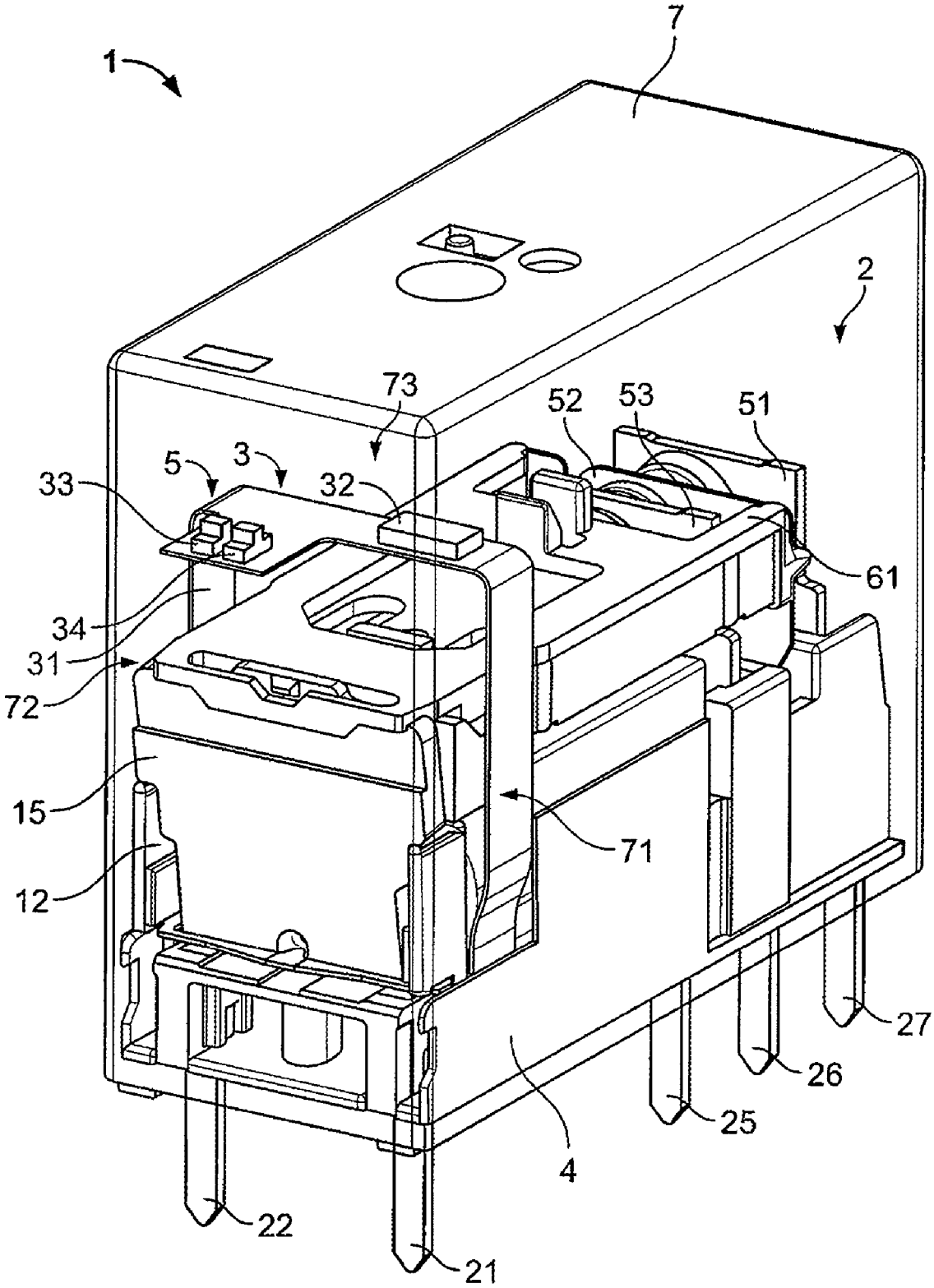
FIG. 2 is a second schematic perspective view of the switchgear shown in FIG. 1.

FIGS. 1-2 show a switchgear 1 according to an embodiment of the invention. In the illustrated embodiment, the switchgear 1 includes a switching device in the form of a relay 2 provided with a connecting assembly 3 and a supplementary electrical circuit 5. It will be appreciated by those skilled in the art, however, that the other embodiments of the switchgear 1 are possible within the scope and spirit of the invention.

Figure 4:
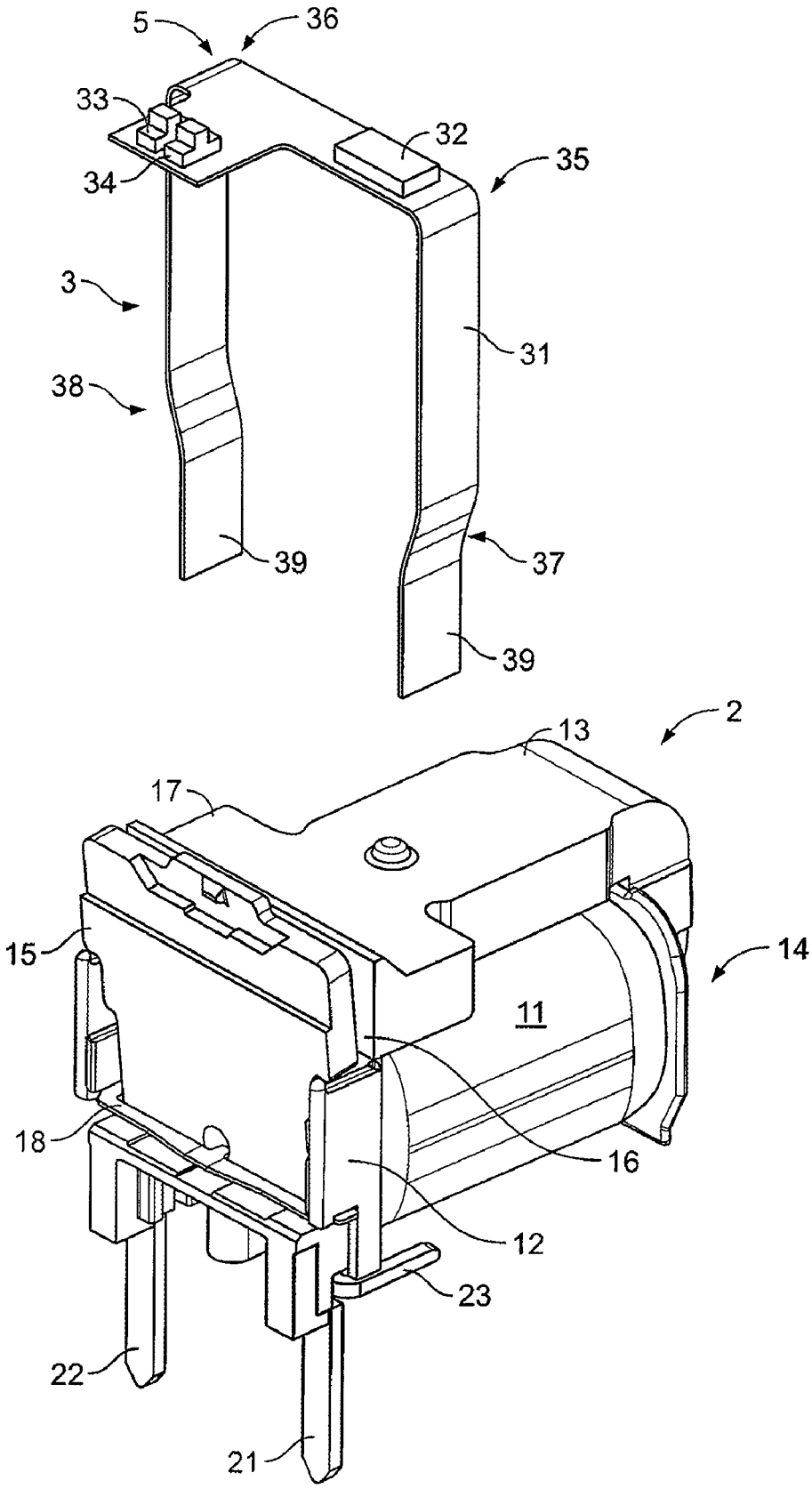
FIG. 4 is an exploded view of the relay and the connecting assembly shown in FIG. 3.

As shown in FIGS. 1-2, the relay 2 is installed in a base unit 4. The relay 2 includes a magnet frame comprising a coil former 12 and a coaxial coil 11 with a yoke 13. The coil former 12 is penetrated by a core 14 that may be integrally connected to the yoke 13 that extends along an exterior of the coil former 12. An armature 15 is mounted at an end of the core 14 and projects from the coil former 12. As shown in FIG. 4, in a region of a free end of the yoke 13, the yoke 13 is equipped with a protruding portion 17 with a thickened area that extends away from the core 14. The protruding portion 17 with the thickened area that extends away from the core 14 creates an enlarged pole face 16. An enlarged top section of the armature 15 covers the pole face 16. A working air gap is formed between the armature 15 and the pole face 16. An armature spring 18 presses the armature 15 in a lower region thereof against the magnet frame in a direction of the core 14. The armature spring 18 is hereby laterally secured to the coil former 12 at projecting lugs, so that the armature spring 18 is fixed to the coil former 12.

Coil terminal pins 21, 22 connected to the coil 11 extend through the base unit 4. The coil terminal pins 21, 22 are configured such that an external operating voltage can be supplied to windings of the coil 11.

As shown in FIGS. 1-2, a coupling device 61 extends adjacent to the yoke 13 and includes a frame-like cut-out 63 that engages a top section of the armature 15. The coupling device 61 is configured to transfer movement of the armature 15 to a switching contact element or spring contact 52 of the relay 2. The armature 15 is supported at one end face on a shoulder of the coil former 12 and at the other end face engages in the cut-out 63 of the coupling device 61 so that when the armature 15 moves towards the pole face 16, the spring contact 52 is actuated via the coupling device 61. The coupling device 61 is provided with a frame-like opening 64 and lateral guide members 62. The lateral guide members 62 are provided on either side of the coupling device 61 and are configured to guide the coupling device 61 along the base unit 4 in an axial direction. Extensions 65 are provided along the axial direction of the coupling device 61 and are configured to engage with the spring contact 52 to actuate the latter.

In the illustrated embodiment, the relay 2 is a double pole relay that includes a switching mechanism consisting of the switching contact element or spring contact 52, a normally-closed contact 53, and a normally-open contact 51. The normally-closed contact 53 and the normally-open contact 51 each act as a mating-contact element for the spring contact 52. For example, the normally-open contact 51 is contacted by the spring contact 52 when the armature 15 bears on the pole face 16. A pair of terminal pins 25 is connected to the normally-closed contact 53. A pair of terminal pins 26 is connected to the transfer contact 52. A pair of terminal pins 27 is connected to the normally-open contact 51. The terminal pins 25, 26, 27 in each of the pairs are connected to each other.

The relay 2 is covered with a housing cover 7. The housing cover 7 is configured to substantially cover the relay 2 including the base unit 4 and the switching mechanism provided thereon.

Figure 3:
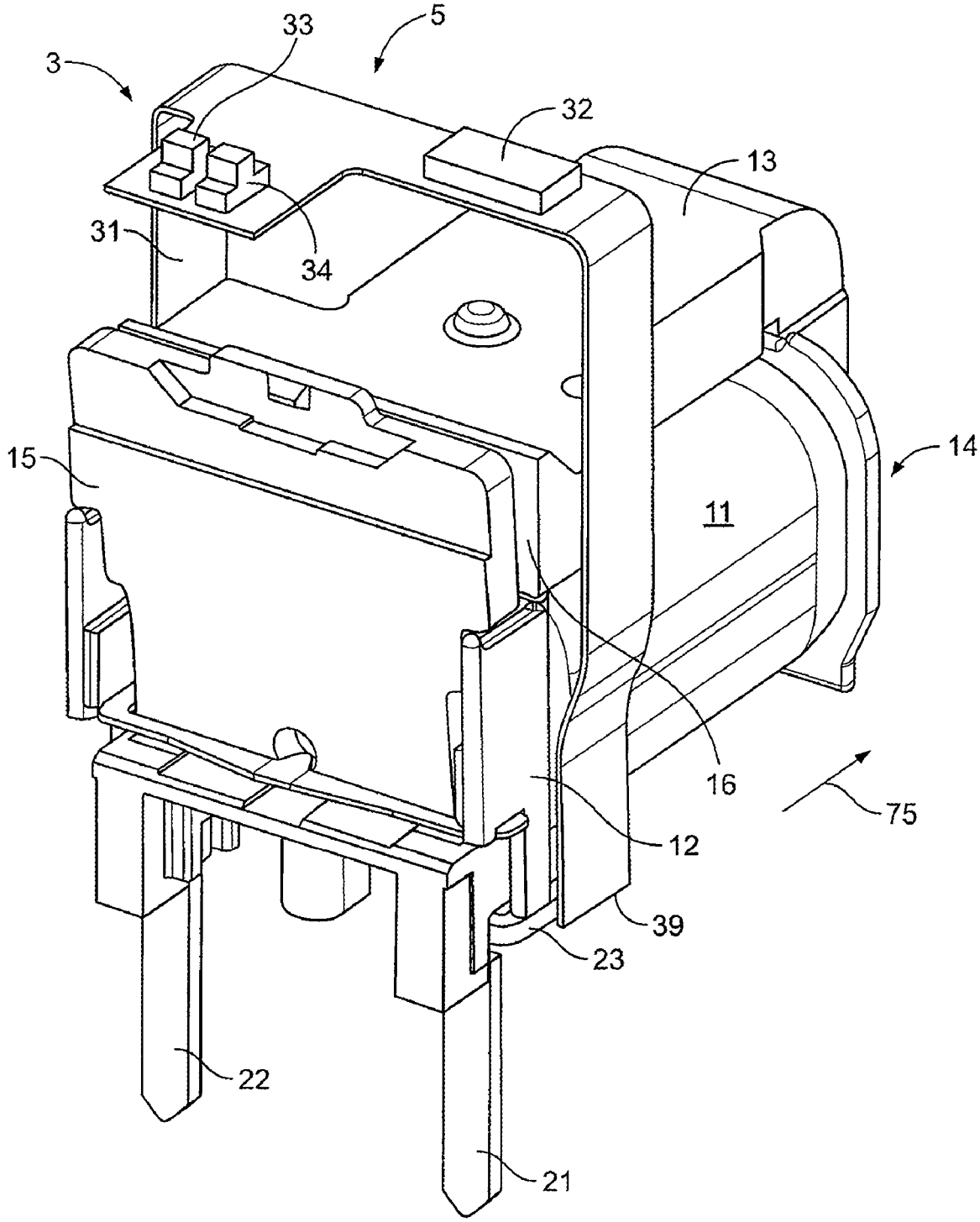
FIG. 3 is a perspective view of a relay and a connecting assembly of the switchgear shown in FIG. 1.

As shown in FIGS. 3-4, the connecting assembly 3 provided with the supplementary electrical circuit 5 is provided on the relay 2. In the illustrated embodiment, the supplementary electrical circuit 5 is an electrical circuit for the relay 2, which supplements the relay 2 and serves to establish the switching mechanism. The supplementary electrical circuit 5 can be installed in the switchgear 1 and is supplied via the terminals of the switchgear 1.

In the illustrated embodiment, as regards the activation of the switching mechanism and a load circuit, the supplementary electrical circuit 5 does not undertake any primary function in relation to the switching operation, but assumes an ancillary function, such as a display or protective function. For example, in the embodiment shown in FIGS. 1-4, the supplementary electrical circuit 5 takes the form of an electrical display circuit. The supplementary electrical circuit 5 comprises electronic components consisting of uni-polar LEDs 33, 34 and a series resistor 32. The uni-polar LEDs 33, 34 are interconnected with the series resistor 32 so that current is limited to the LEDs 33, 34. The connecting assembly 3 contains a printed-circuit board 31 on which the components in the form of the LEDs 33, 34 and the series resistor 32 are disposed. The printed-circuit board 31 is configured to connect the LEDs 33, 34 to the series resistor 32 and to supply an operating voltage to the LEDs 33, 34 and the series resistor 32 from an underside of the coil former 12.

As shown in FIGS. 3-4, the printed-circuit board 31 may be a flexible printed-circuit board, which has a plurality of bends 35, 36, 37, 38. At the bends 35, 36, the printed-circuit board 31 is bent at a bending angle of approximately 90 degrees. At the bends 37, 38, the printed-circuit board 31 is bent such that the printed circuit board 31 closely approaches the housing cover 7. The printed-circuit board 31 has, for example, a substantially U-shape.

Figure 6:
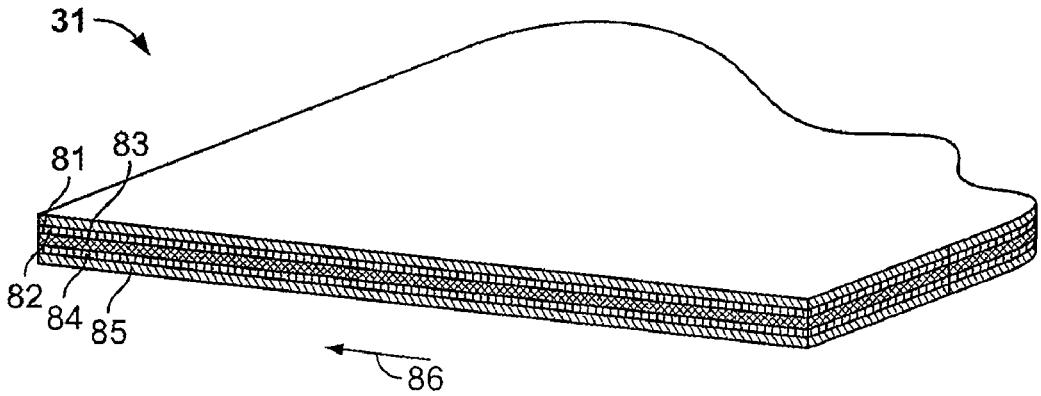
FIG. 6 is a sectional view of a printed-circuit board.

As shown in FIG. 6, the printed-circuit board 31 comprises a layered assembly containing outer insulating material layers 81, 85, adhesive layers 82, 84, and a metallic layer 83. The outer insulating material layers 81, 85 may be, for example, plastic material films that form outer sides of the printed-circuit board 31. The metallic layer 83 may be, for example, disposed between the outer insulating material layers 81, 85. The metallic layer 83 may be, for example, a copper layer. The adhesive layers 82, 84 connect the outer insulating material layers 81, 85 to the metallic layer 83. Breakthroughs (not shown) to the metallic layer 83, such as solder pads, are provided in the printed-circuit board 3 in order to connect the LEDs 33, 34 and the series resistor 32 on the surface of the printed-circuit board 31 to the metallic layer 83.

The layered assembly of the printed-circuit board 31 thereby supplies an operating voltage and connects the LEDs 33, 34 and the series resistor 32 disposed on the printed-circuit board 31. The layered assembly of the printed-circuit board 31 has a thickness of, for example, approximately 0.15 mm. The printed-circuit board 31 may be flexible enough such that printed-circuit board 31 can be bent at an angle of about 180 degrees in a longitudinal direction 86 with a bending radius of, for example, at least 1 mm.

Each of the terminal pins 21, 22 is connected to a connecting terminal pin 23. FIGS. 3-4 only show the connecting terminal pin 23 that is connected to the coil terminal pin 21. The connecting terminal pins 23 extend outward and are connected to the printed-circuit board 31. The connecting terminal pins 23 are bent into the position shown in FIGS. 3-4, for example when the switchgear 1 is manufactured, so that the connecting terminal pins 23 point in a longitudinal direction of the magnet frame. The printed-circuit board 31 is exposed at ends 39 thereof for connection with the connecting terminal pin 23. The ends 39 are exposed such that the metallic layer 83 may be joined, for example, by soldering to the connecting terminal pins 23. The printed-circuit board 31 is thereby fixed on inside surfaces of the connecting terminal pins 23.

The printed-circuit board 31 is thus connected to the operating-voltage supplies of the coil 11 of which the coil terminal pins 21, 23 are a common component. In the event that the coil terminal pins 21, 22 receive an operating voltage, then, depending on polarity, one of the unipolar LEDs 33, 34 illuminates in order to indicate to an operator that the operating voltage is present at the relay 3.

Figure 5:
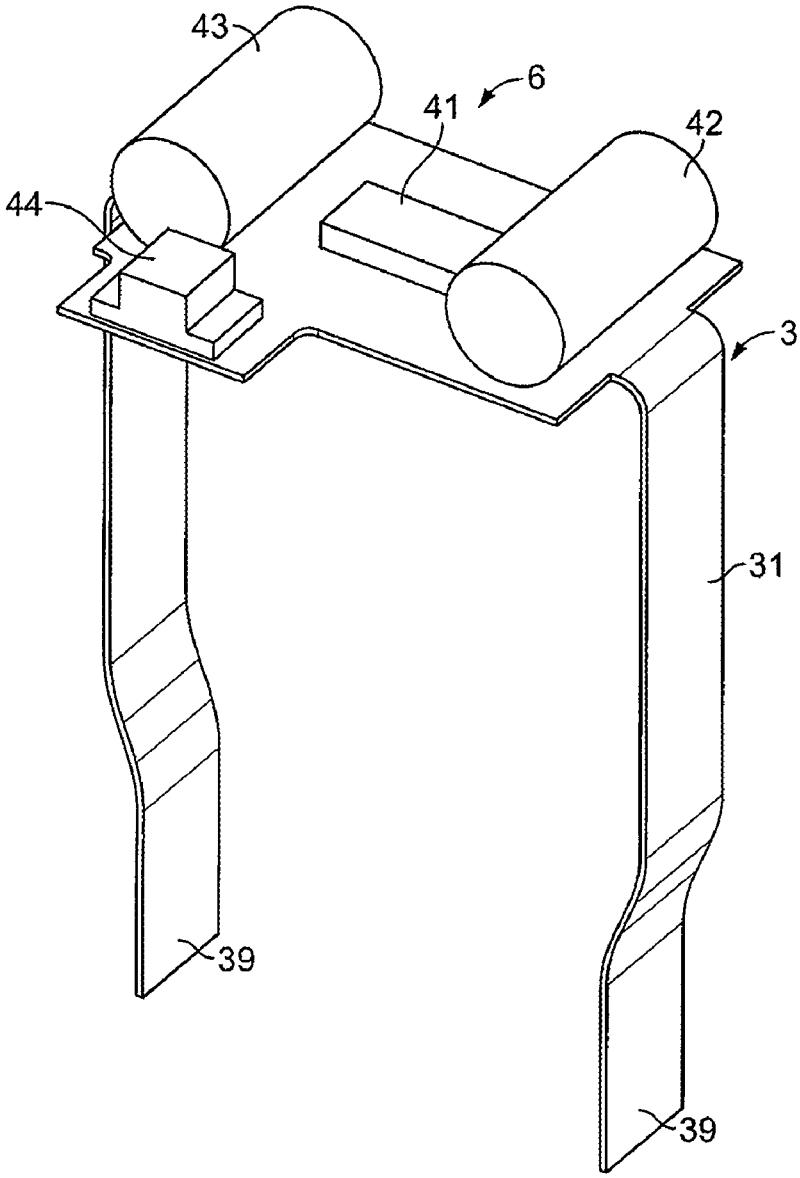
FIG. 5 is a perspective view of a connecting assembly according to another embodiment of the invention.

FIG. 5 shows a connecting assembly 3 with a supplementary electrical circuit 6 according to another embodiment of the invention. The supplementary electrical circuit 6 may be provided for a direct current switchgear (DC application) in a first variant, wherein the supplementary electrical circuit 6 takes the form of an electrical protective circuit. In the illustrated example, the DC application of the supplementary electrical circuit 6 comprises electronic components consisting of a free-wheeling diode 43, a LED 44, and a series resistor 41. The free-wheeling diode 43 prevents any voltages of a non-permitted high level from occurring at the coil 11 of the switchgear 1. The LED 44 may be provided to indicate the operating voltage and may be connected, for example, to the series resistor 41.

The supplementary electrical circuit 6 may be provided for an alternating current switchgear (AC application) in a second variant, wherein the supplementary electrical circuit 6 takes the form of an electrical protective circuit or electrical display circuit. In the illustrated embodiment, the AC application of the supplementary electrical circuit 6 comprises electronic components consisting of a rectifier diode 42, the LED 44, and the series resistor 41. The rectifier diode 42 is disposed on the printed-circuit board 31. The rectifier diode 42 rectifies the alternating current, and may, for example, supply the LED 44, via the series resistor 41, to indicate the operating voltage. Alternatively, an RC element (not shown) may be provided. The RC element (not shown) prevents any voltages of a non-permitted high level from occurring at the coil 11.

The supplementary electrical circuits 5, 6 may be configured, for example, as modular assemblies. For example an LED module may be configured in the case of an electrical display circuit. The modular assembly may therefore be prefabricated and installed as a module in the switchgear 1 in a simple manner.

As shown, in FIGS. 1-2, the printed-circuit board 31 is arranged between the housing cover 7 of the switchgear 1 and the magnet frame of the relay 2. The printed-circuit board 31 encloses the coupling device 61 in a frame-like manner, in regions 71, 72, 73. The printed-circuit board 31 is thereby provided substantially above the coupling device 61. It is therefore possible, with the aid of the printed-circuit board 31, to route the supply of the operating voltage past both sides of the magnet frame and to connect the printed-circuit board 31 to the operating voltage substantially below the magnet frame. Viewed in a longitudinal direction 75 of the magnet frame of the relay 2, the printed-circuit board 31 is disposed between the armature 15 and the contact element 52. The printed-circuit board 31 extends in a substantially transverse direction relative to the longitudinal direction 75 of the magnet frame from the inside surface of the coil former 12 to a top of the magnet frame. In this position, the printed-circuit board 31 may, at least in part, bear on the housing cover 7 at the lateral regions 71, 72. The outer insulating material layers 81, 85 are hereby of dimensions and of a design such that the required dielectric strength exists relative to an inside of the housing cover 7.

In the lateral regions 71, 72, the printed-circuit board 31 extends between the relay 2 and the housing cover 7 substantially transversely relative to the longitudinal direction 75 of the magnet frame, and in the sub-region 73, the printed-circuit board 31 runs substantially parallel to a top of the relay 2 and substantially parallel with a widthways side of the coupling device 61, again substantially transversely relative to the longitudinal direction 75. The printed-circuit board 31 is thereby disposed between the relay 2 and the housing cover 7 and encloses the relay 2 in a frame-like arrangement.

Guide members (not shown) may be formed on an inner wall of the housing cover 7 that receive the printed-circuit board 31 when the housing cover 7 is fitted over the relay 2. The guide members (not shown) may serve to correctly position the housing cover 7 with respect to the printed-circuit board 31.

In the switchgear 1 according to the invention, the printed-circuit board 31 is bent at the bends 35, 36 at a bending angle of approximately 90 degrees. At the ends 39, the printed-circuit board 31 is connected to the connecting terminal pins 23, which are located within the base unit 4. The printed circuit board 31 is then enclosed by the housing cover 7. The printed-circuit board 31 is thereby connected, within the base unit 4, to the connecting terminal pins 23 and is equipped, outside of the base unit 4, with the bends 37, 38 on either side, at which, in each case, the printed-circuit board 31 closely approaches the housing cover 7. The creation of an operating-voltage supply for the electrical components (32, 33, 34, 41, 42, 43, 44) disposed on the printed-circuit board 31 is thereby enabled and comparatively little space is occupied on a side of the magnet frame in the lateral regions 71, 72 of the relay 2. Thus, an extremely compact design of the switchgear 1 is accomplished.

Additionally, the electrical components (32, 33, 34, 41, 42, 43, 44) of the supplementary electrical circuits 5, 6 are connected in parallel with the coil 11. The electrical components (32, 33, 34, 41, 42, 43, 44) are held in position by the printed-circuit board 31 and are directly supplied with the operating voltage via the latter. Thus, no additional wires are necessary for feeding-in the operating voltage. As a result, the space requirement for the switchgear 1 is further reduced.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A switchgear, comprising:

a relay with a magnet frame consisting of a coil former and a coaxial coil with a yoke, the coil having at least one coil terminal pin extending there from configured to supply an operating voltage to the coil;

a flexible printed-circuit board provided with at least one electronic component, the flexible printed-circuit board having a substantially U-shape with substantially parallel ends extending in separate planes, each of the ends extending in a direction of extension of the coil terminal pin and at least one of the ends being electrically connected to the coil terminal pin to form a supplementary electrical circuit, and a relay housing cover positioned over the relay and the flexible printed-circuit board, wherein, the flexible printed-circuit board is sized such that, when viewed in a longitudinal direction of the magnet frame, it is disposed between an armature and a contact element of the relay; the relay is mounted in a base unit and the ends of the flexible printed-circuit board are arranged in the base unit; the electronic component is connected in parallel with the coil; and, the supplementary electrical circuit is an electrical protective circuit or an electrical display circuit.

2. The switchgear of claim 1, wherein the flexible printed circuit board partially bears on the housing cover.

3. The switchgear of claim 1, wherein the flexible printed circuit board is arranged between the relay and the housing cover.

4. The switchgear of claim 1, wherein the flexible printed-circuit board contains a plurality of bends.

5. The switchgear of claim 4, wherein the flexible printed circuit board has at least one bend of at least 90 degrees.

6. The switchgear of claim 1, wherein the flexible printed circuit board includes outer insulating layers disposed on opposite sides of a metallic layer, each of the outer insulating layers being attached to the metallic layer by an adhesive layer disposed there between.

7. The switchgear of claim 1, wherein the flexible printed circuit board has a thickness of approximately 0.15 mm.

8. The switch gear of claim 1, wherein the relay is mounted in a base unit and the flexible printed-circuit board has bends provided proximate the ends, the ends of the flexible printed circuit board being arranged in the base unit and the bends being arranged outside of the base unit.

* * * * *